US005157302A

United States Patent [19]

Tanaka

[11] Patent Number: 5,157,302

[45] Date of Patent: Oct. 20, 1992

[54] COLOR PICTURE TUBE DEVICE WITH STATIC CONVERGENCE ADJUSTER

[75] Inventor: Toshihiko Tanaka, Mobara, Japan

[73] Assignee: Hitachi, Ltd., Tokyo, Japan

[21] Appl. No.: 439,837

[22] Filed: Nov. 21, 1989

[30] Foreign Application Priority Data

Nov. 22, 1988 [JP] Japan ..... 63-293509

[51] Int. Cl.[5] ..... H01J 29/68

[52] U.S. Cl. ..... 313/412; 313/421; 313/428

[58] Field of Search ..... 313/412, 420, 427, 421, 313/428

[56] References Cited

U.S. PATENT DOCUMENTS 3,305,744 2/1967 Werst ..... 313/412
3,354,336 11/1967 Rennick ..... 313/412
3,505,560 4/1970 Marvin ..... 313/412
4,625,144 11/1986 Kornaker ..... 313/412
4,670,726 6/1987 Ogata et al. ..... 313/427
4,766,343 8/1988 Belica ..... 313/412

*Primary Examiner*—Donald J. Yusko
*Assistant Examiner*—John Giust
*Attorney, Agent, or Firm*—Antonelli, Terry Stout & Kraus

[57] ABSTRACT

A color picture tube device equipped with a static convergence adjuster for outer electron beams. The magnetic lines of force of the quadrupole field produced by the adjuster have substantially straight vertical portions. The device is capable of suppressing broadening of the vertical diameters of the spots of the outer beams. Deterioration in the resolution concomitant with adjustment of the convergence of the outer beams can be suppressed.

14 Claims, 3 Drawing Sheets

COLOR PICTURE TUBE DEVICE WITH STATIC CONVERGENCE ADJUSTER

FIELD OF THE INVENTION

The present invention relates to a color picture tube device and, more particularly, to a color picture tube device equipped with an outer beam static convergence adjuster providing improved vertical resolution.

BACKGROUND OF THE INVENTION

A color picture tube equipped with in-line electron guns emitting three electron beams onto the same plane is required to have a convergence adjuster which causes the electron beams to converge on the viewing screen.

A color picture tube device of this kind is schematically shown in FIG. 1. This device comprises a glass bulb 501 including a funnel 502 and a neck 503. The tube further includes a fluorescent screen 504 forming a viewing screen, a shadow mask 505, a magnetic shield 506, a deflection yoke 507, purity magnetic rings 508, convergence-adjusting magnets 509 for the central beam 1, other convergence-adjusting magnets 510 for the outer beams 2, and electron guns 511.

In this color picture tube device, static convergence is achieved by causing the two outer beams 2 to converge and then bending the outer beams so as to converge with the central beam.

Since the structures and the functions of the deflection yoke 507, the purity magnetic rings 508, the convergence-adjusting magnets 509 for the central beam, etc. are known, they are not described in detail herein.

FIG. 2 is a view for illustrating a method of achieving static convergence by bringing the outer beams substantially into the center of the viewing screen. The figure shows the central beam 1, the outer beams 2, magnetic lines of force 5, and electromagnets or permanent magnets 24.

The orbits of the outer beams 2 are bent by the Lorentz force of magnetic lines of force formed by the quadrupole field, which is created by the magnets 24 of the same magnitude. Thus, the two outer beams 2 converge on the viewing screen.

FIGS. 3*a* and 3*b* illustrate ring magnets which together act as a static convergence adjuster for the outer beams and produce the aforementioned quadrupole field. FIG. 3(*a*) shows the first ring magnet, and FIG. 3(*b*) shows the second ring magnet. These two magnets are held by magnet holders 23-*a* and 23-*b*, respectively, which have operation protrusions 23-1 and 23-2, respectively.

Each ring magnet has north poles and south poles which are spaced 90° from each other circumferentially of the magnet holder 23-*a* or 23-*b*. Like poles are positioned diametrically opposite to each other. When the operation protrusions 23-1 and 23-2 of the ring magnets of FIGS. 3(*a*) and 3(*b*) are superimposed, the north poles of one ring magnet are placed on the south poles of the other, so that the magnetic lines of force are canceled out. Under this condition, the ring magnets are installed on the neck of the color picture tube. The operation protrusions 23-1 and 23-2 are rotated in opposite directions with the magnet holders. In this way, the electron beams are subjected to the quadrupole field. The outer beams 2 are made to converge by adjusting the intensity of the magnetic field. The intensity of the field is maximized when the two ring magnets of FIGS. 3(*a*) and 3(*b*) are rotated through 45° in opposite directions. The quadrupole field produced by the ring magnets for achieving the convergence of the outer beams is characterized in that it is maintained in a square arrangement.

A color picture tube having no magnetic field for convergence adjustment is generally designed so that a so-called under convergence is achieved, i.e., the arrangement of the electron beams at the position of the neck of the picture tube is the same as the arrangement of the beams on the viewing screen. The quadrupole field is so set up that when the convergence of the outer beams is adjusted, the outer beams are deflected towards the central beam. A device of this kind is disclosed in, for example, Japanese Patent Laid-Open No. 200648/1986.

In the conventional technology device, the quadrupole field takes a square arrangement as shown in FIG. 2. The pattern of the magnetic lines of force is of the pincushion type.

FIG. 4 illustrates the effect of the quadrupole field upon the outer beams. The magnetic line of force 5 passing through each outer beam 2 is curved, i.e., the pattern of the magnetic lines of force is of the pincushion type. When forces 7 and 8 directed toward the central beam, i.e., horizontally, act on the beam 2, forces 9 which are perpendicular to the forces 7 and 8 and are directed vertically act on the beam 2. As a result, the outer beam 2 is bent toward the central beam, i.e., directed horizontally, and, at the same time, diverge vertically. This deteriorates the vertical resolution.

SUMMARY OF THE INVENTION

It is an object of the present invention to provide a color picture tube device which reduces deterioration in the resolution that is caused by adjusting the convergence of the outer beams.

The above object is achieved by the provision of a convergence adjuster producing a quadrupole field through which outer beams are caused to pass for convergence adjustment, the magnetic poles of the magnets of the adjuster which are close to the vertical axis being stronger than the magnetic poles close to the horizontal axis, the pattern of the magnetic lines of force being such that it is elongated vertically and that the vertical components of the magnetic lines of force approach straight lines, rather than a square pattern of the pincushion type.

Since the vertical components of the magnetic lines of force acting on the outer beams are almost straight, the forces (7 in FIG. 4) acting on the electron beams are approximated by the components (8 in FIG. 4) directed exactly toward the central beam and so their vertical components (9 in FIG. 4) are almost null. Therefore, the quadrupole field does not cause the outer beams to diverge vertically. Consequently, the vertical resolution is prevented from deteriorating.

DESCRIPTION OF THE PREFERRED EMBODIMENTS

Figure 5:
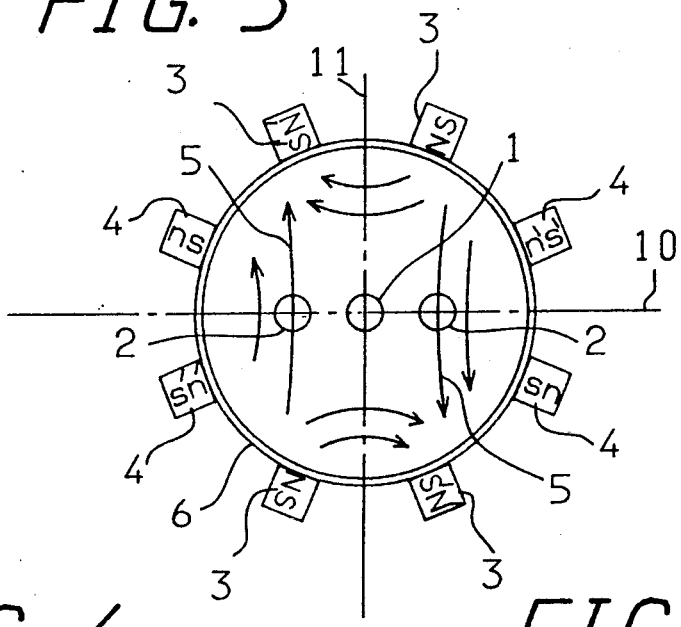
FIG. 5 is a view illustrating the arrangement of magnetic poles of an outer beam convergence adjuster according to the invention and the pattern of the produced quadrupole field, the adjuster being installed on the neck of a color picture tube device.

FIG. 5 illustrates the arrangement of the magnetic poles of an outer beam convergence adjuster according to the invention, as well as the pattern of the produced quadrupole field. The convergence adjuster is installed on the neck 6 of a color picture tube device. Also shown in this figure are a central beam 1, outer beams 2, magnets 3 producing strong magnetic force, magnets 4 producing weak magnetic force, the horizontal axis 10, and the vertical axis 11.

Figure 4:
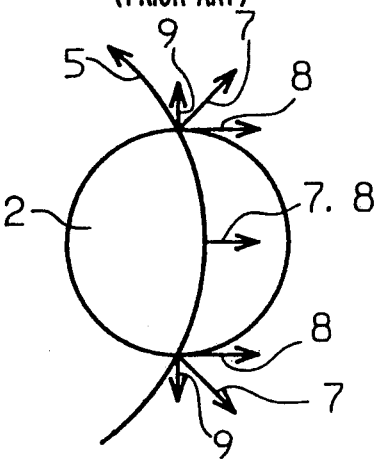
FIG. 4 (PRIOR ART)
FIG. 4 is a view illustrating the effect of the quadrupole field shown in FIG. 2 upon the outer beams.
Figure 6:
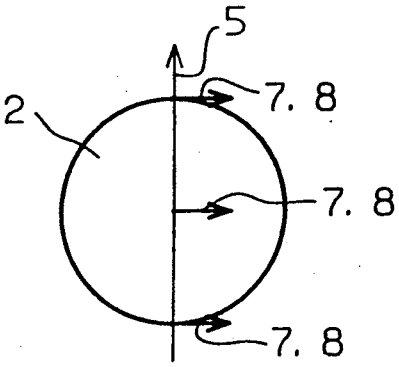
FIG. 6 is a view illustrating the effect of the quadrupole field upon outer beams, the effect being utilized for the present invention.

As can be seen from FIG. 5, the magnetic force produced by the north poles (indicated by N and N') and the south poles (indicated by S and S') of the strong magnets 3 close to the vertical axis 11 is stronger than the magnetic force produced by the north poles (indicated by n and n') and the south poles (indicated by s and s') of the weak magnets 4 close to the horizontal axis 10. The resultant magnetic pole is close to the vertical axis 11. That is, the effective pattern of the quadrupole field is rectangular and elongated vertically. As a result, the vertical sides of the pincushion type distribution pattern of the magnetic lines of force passing through the outer beams 2 approach straight lines. Hence, as illustrated in FIG. 6, the forces 7 acting on the outer beams 2 approximate forces 8 directed toward the central beam. This means that the forces 9 which stretch the electron beams upwardly and downwardly as described in connection with FIG. 4 almost disappear. Consequently, the electron beams do not diverge vertically. That is, deterioration in the vertical resolution caused by the magnetic field for adjusting the convergence of the outer beams 2 is reduced.

Figure 3A:
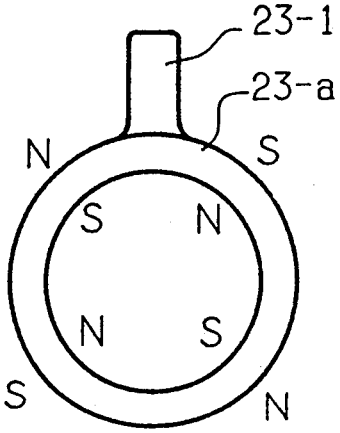
FIG. 3(a) (PRIOR ART)
FIGS. 3*a* and 3*b* are schematic diagrams of ring magnets for producing the quadrupole field shown in FIG. 2.
Figure 3B:
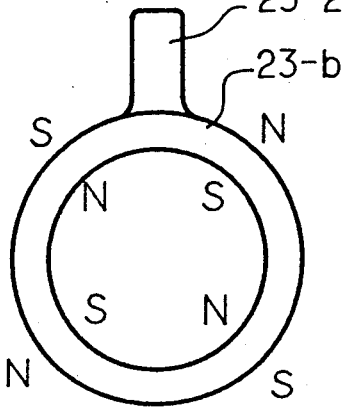
FIG. 3(b) (PRIOR ART)
Figure 7A:
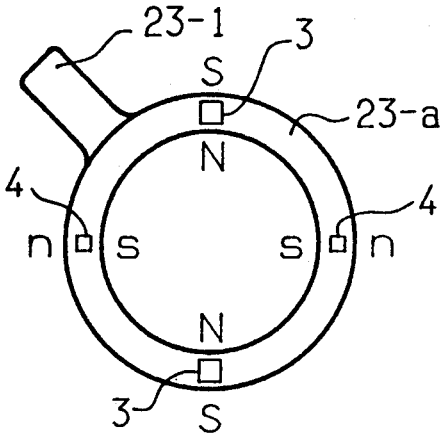
FIGS. 7*a* and 7*b* are schematic diagrams of a convergence adjuster for producing four magnetic poles in accordance with the present invention.
Figure 7B:
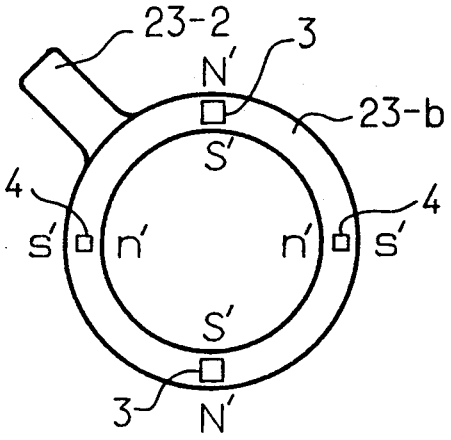

FIGS. 7*a* and 7*b* show one example of the convergence adjuster for producing a quadrupole field in accordance with the present invention. In this figure, (a) shows the first ring magnet, and (b) shows the second ring magnet. These ring magnets are held by magnet holders 23-*a* and 23-*b*, respectively, which have operation protrusions 23-1 and 23-2, respectively. Magnets 3 and 4 are disposed on the magnet holder 23-*a*. Similarly, other magnets 3 and 4 are disposed on the magnet holder 23-*b*. These magnets 3 and 4 are arranged in the same manner as the configuration already described in conjunction with FIG. 3.

Each of the magnets 3 and 4 is made from an alloy Fe-Cr-Co or other similar material. The magnetic force created by the magnets 3 is larger than the magnetic force produced by the magnets 4. Where the magnets are permanent magnets, the magnetization intensity is set by determining the size of the magnets. Where the magnets are electromagnets, the magnetization intensity is set by determining the ampere-turn. The two magnet holders 23-*a* and 23-*b* are installed on the neck. The arrangement is such that a quadrupole field pattern as shown in FIG. 5 is created.

Figure 8A:
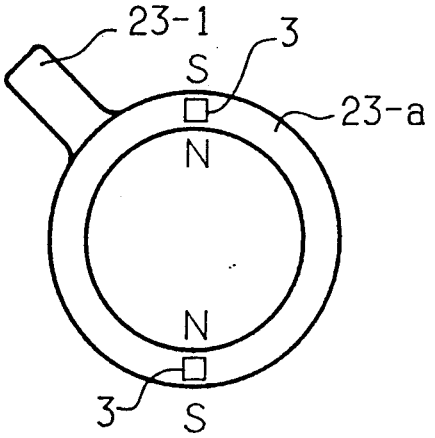
FIGS. 8*a* and 8*b* are schematic diagrams similar to FIGS. 7*a* and 7*b*, but showing another convergence adjuster according to the invention.
Figure 8B:
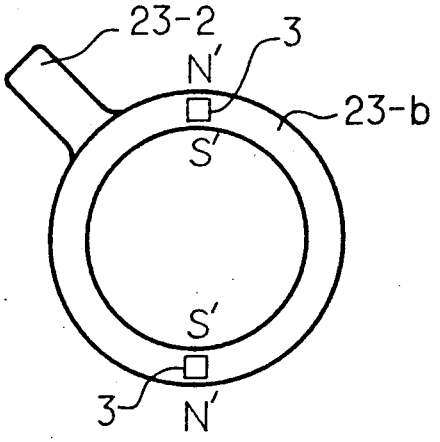

FIGS. 8*a* and 8*b* show another example of a convergence adjuster for producing a quadrupole field in accordance with the present invention. FIG. 8 (a) shows the first ring magnet, and FIG. 8 (b) shows the second ring magnet. These two magnets are held by magnet holders 23-*a* and 23-*b*, respectively, which have operation protrusions 23-1 and 23-2, respectively. Magnets 3 are disposed close to the vertical axis. This convergence adjuster differs from the adjuster shown in FIGS. 7*a* and 7*b* in that the magnets disposed close to the horizontal axis are omitted.

Figure 9:
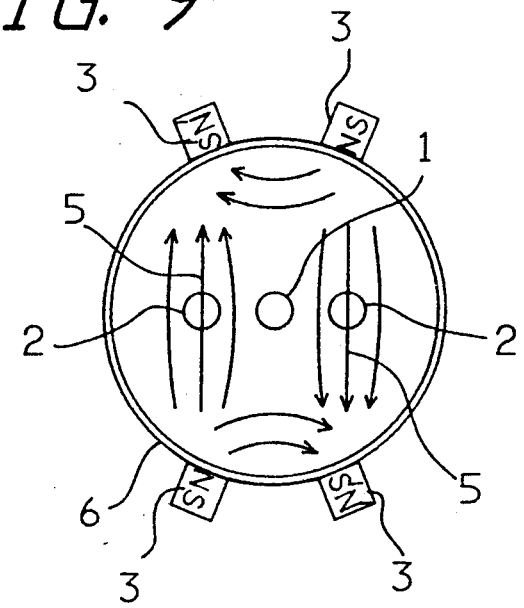
FIG. 9 is a view illustrating the arrangement of the magnetic poles of the outer beam convergence adjuster shown in FIG. 8, as well as the pattern of the produced quadrupole field.

FIG. 9 is a pictorial representation of the pattern of the quadrupole field created by the two ring magnets shown in FIGS. 8*a* and 8*b*. As can be seen from this figure, the magnetic lines of force acting on the outer beams 2 are straighter than the magnetic lines of force shown in FIG. 5. In this example, the number of magnets being used is four, whereas eight magnets are employed in the example shown in FIGS. 7*a* and 7*b*. Therefore, the example shown in FIG. 9 has the advantage of reduced cost.

Figure 1:
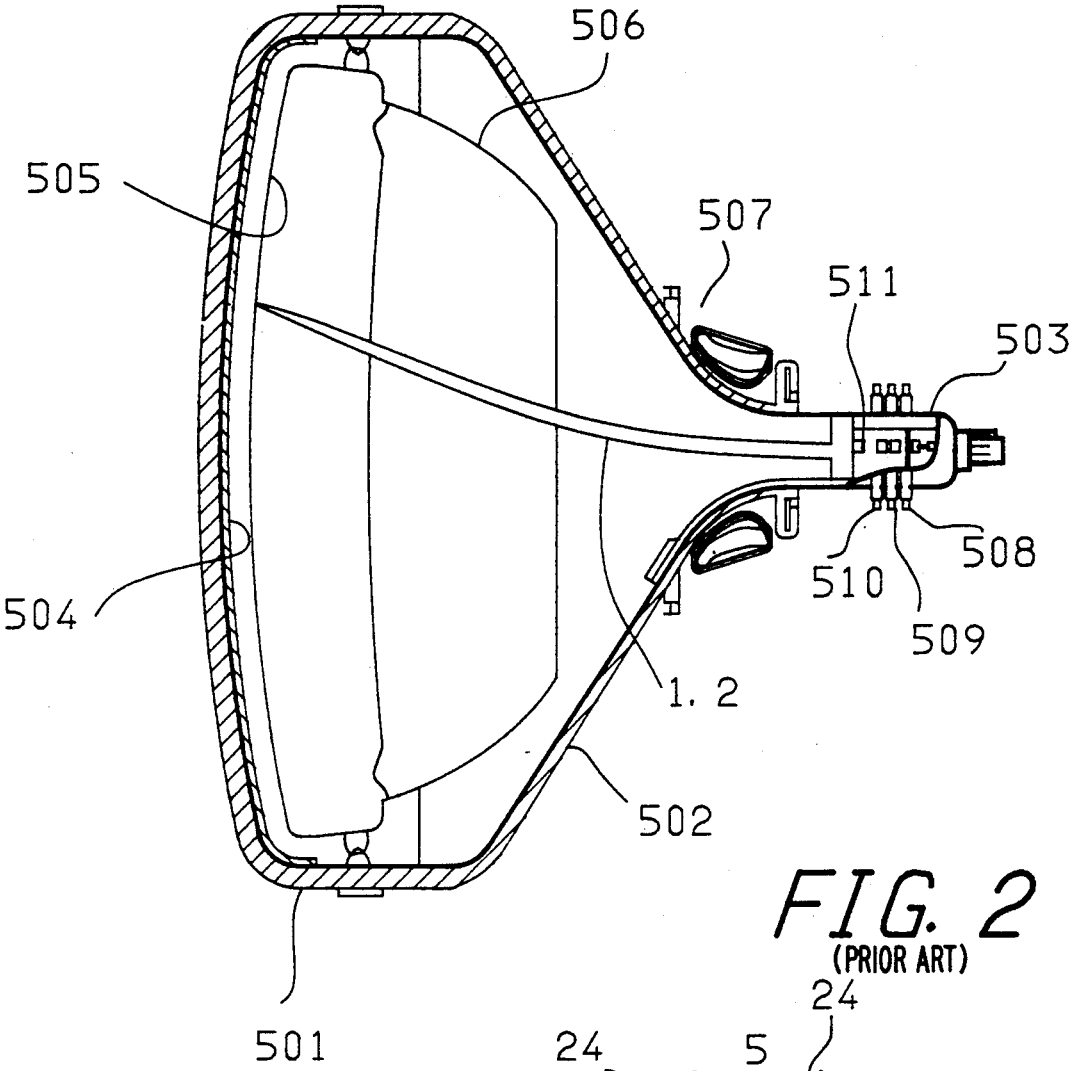
FIG. 1 (PRIOR ART)
FIG. 1 is a schematic cross section of a conventional color picture tube device.
Figure 2:
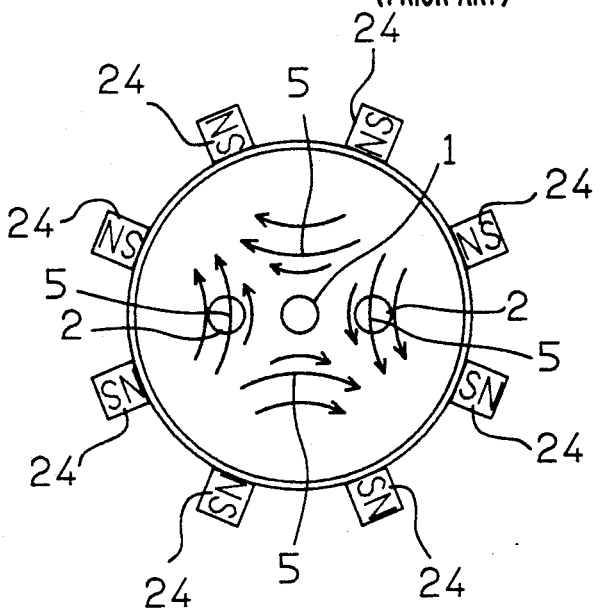
FIG. 2 (PRIOR ART)
FIG. 2 is a view illustrating a method of adjusting static convergence, for bringing outer beams substantially into the center of a viewing screen.

The aforementioned examples of outer beam convergence adjuster were applied to high-definition color picture tubes each equipped with a 14-in. screen. The diameters of the spots of red beams were actually measured. The cathode current was set to 150 μA. The measured diameters were compared with the values obtained using the conventional outer beam convergence adjuster shown in FIGS. 2 and 3. The results are indicated in the Table given below.

TABLE

| | prior art | novel |
|---|---|---|
| vertical diameter | 0.96 mm | 0.84 mm |
| horizontal diameter | 0.60 mm | 0.60 mm |

It has been confirmed that the beam spot diameter taken vertically was reduced by as much as 0.12 mm. As a result, the vertical resolution was improved greatly.

As described thus far, in accordance with the present invention, the magnetic lines of force of the quadrupole field which act on the outer beams and are used for convergence adjustment are made substantially straight along the vertical axis. This enables a broadening of the vertical diameters of the spots of the outer beams to be suppressed. Hence, a color picture tube device having excellent vertical resolution can be offered.

What is claimed is:

1. A color picture tube device, comprising:

in-line electron guns installed in the neck of a color picture tube and emitting a central electron beam and outer electron beams; and a static convergence adjuster mounted upon the neck of said color picture tube to effect static convergence of said outer electron beams including means for producing a quadrupole field inside the neck in such a way that the lines of force acting on said outer electron beams are substantially linear, so that the forces acting on the outer electron beams are directed substantially only toward said central electron beam.

2. The color picture tube device of claim 1, wherein said static convergence adjuster for said outer electron beams consists of a plurality of magnets movably mounted upon the neck of the color picture tube, some of said magnets producing a stronger magnetic force than the other magnets.

3. The color picture tube device of claim 1, wherein said static convergence adjuster has a plurality of magnetic poles which produce vertical and substantially straight magnetic lines of force in said quadrupole field acting upon said outer electron beams.

4. The color picture tube device of claim 1, wherein the magnetic lines of force of said quadrupole field produced by said static convergence adjuster are elongated vertically.

5. The color picture tube device of claim 1, wherein the magnetic force of the magnetic poles which are located close to the vertical axis in said static convergence adjuster is stronger than the magnetic force of the magnetic poles located close to the horizontal axis.

6. A color picture tube device of claim 1, wherein all the magnetic poles of said static convergence adjuster are located closer to the vertical axis than to the horizontal axis.

7. The color picture tube device of claim 1, wherein said static convergence adjuster for said outer electron beams includes first and second annular support members each having only two magnetic field generating devices diametrically disposed thereon.

8. A color picture tube device of claim 1, where said static convergence adjuster includes said first and second annular support members each having two diametrically disposed pairs of magnetic field generating devices, one of said pairs of magnetic field generating devices on at least one of said annular support members producing a magnetic field of higher intensity than the magnetic field produced by the other pair of magnetic field generating devices thereon.

9. A color picture tube device, comprising:

a color picture tube having an in-line electron gun assembly installed in the neck thereof for emitting a center electron beam and outer electron beams in-line therewith; and a static convergence adjuster mounted on the neck of said color picture tube to effect static convergence of said outer electron beams and including magnetic field generating devices positioned to produce an elongated substantially rectangular quadrupole field having substantially linear field lines in the elongated direction, which produce forces acting on said outer electron beams within the neck of the color picture tube that are directed substantially entirely toward said central electron beam.

10. A color picture tube device of claim 9, wherein said static convergence adjuster for said outer electron beams includes first and second annular support members each having only two magnetic field generating devices diametrically disposed thereon.

11. The color picture tube device of claim 9, wherein the static convergence adjuster includes first and second annular support members each having two diametrically disposed pairs of magnetic field generating devices, one of said pairs of magnetic field generating devices on at least one of said annular support members producing a magnetic field of higher intensity than the magnetic field produced by the other pair of magnetic field generating devices thereon.

12. A color picture tube device according to claim 1, further including a color purity adjuster mounted on the neck.

13. A color picture tube, comprising:

in-line electron guns installed in the neck of a color picture tube and emitting a central electron beam and outer electron beams; and a static convergence adjuster mounted on the neck of said color picture tube to effect static convergence of said outer electron beams toward said central electron beam by producing a quadrupole field inside the neck, said static convergence adjuster having a plurality of magnetic poles which produce magnetic forces on said outer electron beams, said magnetic poles located close to a vertical axis in said static convergence adjuster producing forces which are stronger than said magnetic forces by said magnetic poles which are close to a horizontal axis in said static convergence adjuster, the magnetic lines of force of said quadrupole field acting upon said outer electron beams being vertical and substantially straight, with the result that the forces acting on said outer electron beams are directed substantially only toward said central electron beam.

14. A color picture tube device, comprising:

a color picture tube having an in-line electron gun assembly installed in the neck thereof for emitting a center electron beam and outer electron beams in-line therewith; and a static convergence adjuster mounted on the neck of said color picture tube and including magnetic field generating device positioned to produce a vertically elongated substantially rectangular quadrupole field having substantially linear field lines in the elongated direction which produce magnetic forces on said outer electron beams, said device located close to the vertical axis in the adjuster producing magnetic forces which are stronger than said magnetic forces produced by the devices which are close to the horizontal axis in the adjuster, so that forces acting on said outer electron beams within the neck of the color picture tube are directed substantially entirely toward said central electron beam.

* * * * *